United States Patent [19]

Riggs

[11] Patent Number: 4,606,183

[45] Date of Patent: Aug. 19, 1986

[54] LUBRICATED AND THERMOPLASTIC IMPREGNATED WIRE ROPE

[75] Inventor: Peter P. Riggs, Ballaugh Glen, United Kingdom

[73] Assignee: AMSTED Industries Incorporated, Chicago, Ill.

[21] Appl. No.: 673,547

[22] Filed: Nov. 20, 1984

[51] Int. Cl.[4] ..... D07B 1/10; D07B 1/16; D07B 7/12

[52] U.S. Cl. ..... 57/221; 57/217; 57/7

[58] Field of Search ..... 57/217, 223, 232, 241, 57/258, 7, 295

[56] References Cited

U.S. PATENT DOCUMENTS

| | | | |
|---|---|---|---|
| 3,547,819 | 12/1970 | Davis et al. | 384/286 X |
| 3,800,522 | 4/1974 | Hughes | 57/221 X |
| 3,824,777 | 7/1974 | Riggs | 57/214 |
| 3,874,158 | 4/1975 | Chiappetta | 57/214 |
| 4,197,695 | 4/1980 | Hughes et al. | 57/221 X |
| 4,344,278 | 8/1982 | Jamison et al. | 57/221 |

*Primary Examiner*—Donald Watkins

*Attorney, Agent, or Firm*—Charles E. Bouton; Edward J. Brosius

[57] ABSTRACT

A wire rope including a core surrounded with a plurality of wound strands. The rope is encapsulated with a thermoplastic after the application of a lubricant blend including amorphous polypropylene.

13 Claims, 3 Drawing Figures

LUBRICATED AND THERMOPLASTIC IMPREGNATED WIRE ROPE

BACKGROUND OF THE INVENTION

The present invention relates to thermoplastic or elastomer impregnated and lubricated wire ropes and more particularly to the blending of such lubricants with amorphous polypropylene to improve the bonding between the lubricant and the wire rope strands and between the lubricant and the impregnating thermoplastic.

Various methods of impregnating wire rope with different types of thermoplastic material are known to improve the fatigue life, to reduce wire contact stresses and to inhibit corrosion of the wire rope. Certain such methods are disclosed in U.S. Pat. No. 3,824,777. A limiting factor effecting the corrosion resistance of thermoplastic impregnated wire ropes is that during the impregnation process, the high temperatures involved lead to the partial migration of the lubricant in the rope from contact with the wire strands. Further, no effective bond between the lubricant and the impregnating thermoplastic has been observed. Accordingly, if minor external damage occurs to the rope coating in a relatively small area, it is possible for contaminating elements to enter through the opening in the thermoplastic and to be drawn along the length of the wires of the wound rope strands by capillary action. Such action has a tendency to increase the internal corrosion of the wire rope.

An important factor in the corrosion resistance of a lubricated, thermoplastic impregnated wire rope is to insure that the inner wire rope core and each outer strand have a good quality lubricant uniformly distributed therein to maintain fatigue resistance of the strand and core. Further, the lubricant should have a high degree of elasticity to accept the bending and stretching of the wire rope in service. The lubricant should have a high degree of resistance to migration from the strands at the elevated temperatures necessary to effect the thermoplastic impregnation of the wire rope. Additionally, it is desirable that the lubricant material possess the ability to bond to the thermoplastic material impregnated into the wire rope. Typically, such thermoplastics include polypropylene, polyurethane, polyethylene, nylon or tetrafluoroethylene.

Accordingly, it is an object of the present invention to provide a wire rope and a method for making the same which utilizes a lubricant containing compound having a good adhesion quality to the wire strands and further having the ability to be bonded to the thermoplastic in-filling material.

SUMMARY OF THE INVENTION

The present invention provides a wire rope and a method for making the same wherein an improved lubricant containing compound is applied to either the multiwire core alone or to the multiwire core and the outer strands of the wire rope. Then a thermoplastic coating is applied to either the core alone or to the assembled rope whereby the infilling thermoplastic fills the interstices between the core or IWRC and the outer strands. Such thermoplastic may extend to the outer diametrical limit of the outer strands or slightly beyond.

In accordance with the present invention an amorphous polypropylene is blended with a lubricant material such as traditional wire rope lubricants as petrolatum, vegetable oils or asphaltic based lubricants or with types of synthetic lubricants or powdered solid lubricants such as graphite and molybdenum disulphide or with mixtures thereof. Such amorphous polypropylene lubricant blends have been shown to provide a highly efficient lubricating compound that may be applied to the wires of the strand during fabrication. If only the core strand of the wire rope is to be impregnated with thermoplastic, the core strand is passed through a wipe to remove any excess lubricant blend left on the surface of the strands. Such excess lubricant blend tends to impede the impregnation of the thermoplastic into the core. The outer strands are then wound about the thermoplastic encapsulated core.

If the entire wire rope is impregnated or encapsulated with the thermoplastic, after application of the lubricant amorphous polypropelene of the strands and core are passed through a wipe to remove excess lubricant blend on the surface of the outer strands and core. The excess lubricant blend impedes the impregnation of the thermoplastic into the finished rope. Upon the removal of such excess lubricant blend, the thermoplastic is extruded into the interstices between the core and the outer strands and between the outer strands to extend to the diametrical limit of the outer strands or slightly beyond as desired.

The amorphous polypropelene lubricant blend remains within strands and core to maintain good fatigue resistance of the strands and the core and exhibits sufficient elasticity during bending and stretching of the rope. The melting point of the amorphous polypropelene lubricant blend is preferrably sufficiently high to prevent ingress flow thereof when the rope is subsequently impregnated with thermoplastic during the extrusion process. The lubricant blend also has the characteristics which enable it to bond to the impregnated thermoplastic to create, in effect, a cross-section of wire strand, lubricant and thermoplastic. Such an arrangement of lubricated, thermoplastic impregnated wire rope prevents the ingress of external corrosive agents within the rope in the event of external penetration or damage to external thermoplastic in filling a jacket.

In particular, the present invention provides a wire rope comprising a core and multi-wire outer strands surrounding the core, a amorphous polypropelene lubricant blend permeating, the core and the outer strands and a thermoplastic encapsulating the core and the outer strands, the lubricant is selected from the group of conventional lubricants, synthetic lubricants or powdered solid lubricants.

The present invention also provides the method of manufacturing a wire rope including the steps of winding individual wires to form a core strand and several outer strands, permeating the core and the outer strands with a lubricant blend comprising amorphous polypropylene and a lubricant selected from the group of conventional lubricants, synthetic lubricants and powdered solid lubricants, wiping the excess of said lubricants from the outer surfaces of the core strand and the outer strands, winding said core strand and the outer strands together to form a wire rope, and injecting a thermoplastic into said wire rope.

DESCRIPTION OF THE PREFERRED EMBODIMENTS

Figure 1:
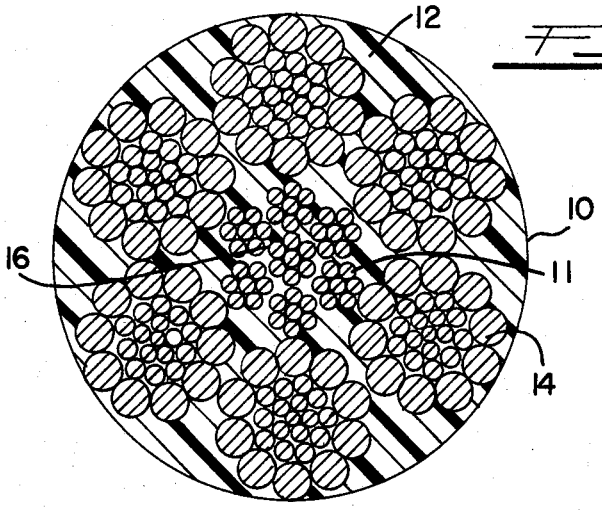
FIG. 1 is a cross-section of a wire rope in accordance with the present invention wherein the thermoplastic jacket extends to the outer periphery of the outer strands.

Referring now to FIG. 1, a wire rope is shown generally at 10 comprising a core or IWRC 16 including a plurality of strands 11. Core 16 is surrounded by a plurality of outer strands 14 which conventionally comprise a plurality of individual wires. Outer strands 14 and core 16 are surrounded by a thermoplastic 12 which extends into the interstices between core 16 and outer strands 14.

In the manufacture of wire rope 10, core 16 and outer strands 14 are immersed or injected with a lubricant blend of amorphous polypropylene and a conventional petroleum lubricant, a synthetic lubricant or a powdered solid lubricant. Thereafter excess lubricant is wiped from the outer surface of the strands and core. The strands 14 are then wound about core 16 to form a rope. The wire rope containing the lubricant blend is pre-heated to a temperature in the range of 100° to 300° F. (38° to 148° C.). A thermoplastic or elastomer 12 is then extruded under pressure in the range of 1500 to 5000 PSI (105 to 352 KG/CM2). In this embodiment of the present invention, thermoplastic 12 extends to the diametrical outer limit of outer strands 14.

Figure 2:
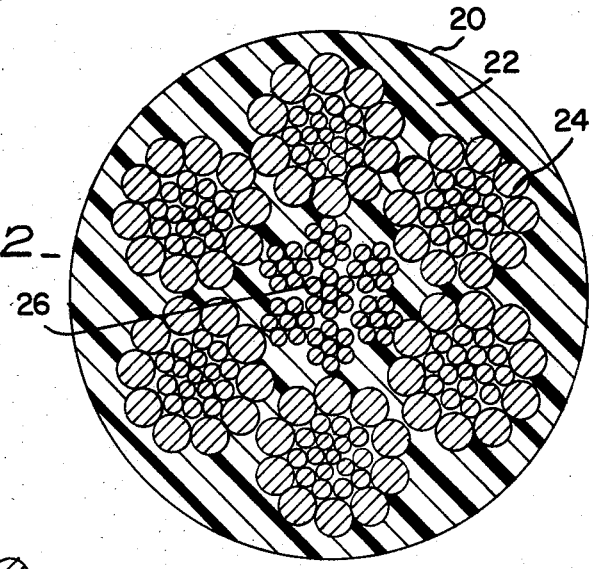
FIG. 2 is a cross-section of another embodiment of the present invention wherein the thermoplastic jacket extends beyond the outer diameter of the outer strands.

Referring now to FIG. 2, a second embodiment of the present invention comprises a wire rope shown generally at 20 including a core 26 surrounded by a plurality of outer strands 24. Thermoplastic 22 extends into the interstices between core strand 26 and outer strands 24, extending radially beyond the outer diametrical limits of outer strands 24.

Wire rope 20 is assembled in a manner similar to that explained above for wire rope 10. Such assembly includes the lubrication of the core 26 and outer strands 24 with a lubricant blend comprising a amorphous polypropylene and a conventional petroleum lubricant, synthetic lubricant or powdered solid lubricant.

Figure 3:
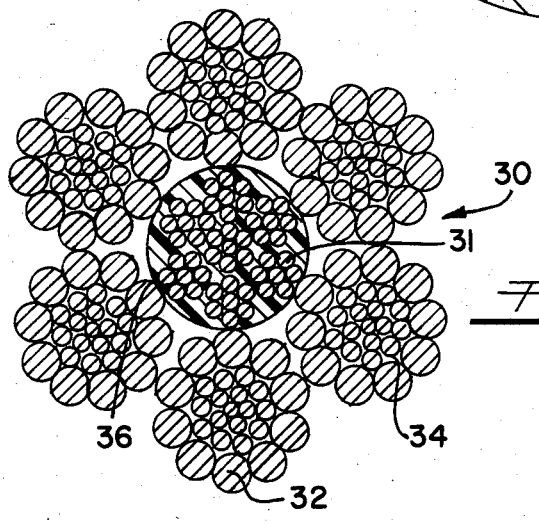
FIG. 3 is a cross-section of another embodiment of the present invention wherein the thermoplastic jacket surrounds the core of the wire rope.

Referring now to FIG. 3, a third embodiment of the present invention comprises wire rope 30 having Central core 31 surrounded by a plurality of individual strands. Core 31 is encapsulated by a thermoplastic sheath 36 which extends to the outer diametrical limit of core 31. The core 31 is surrounded by a plurality of outer strands 34, each of which is comprised of a plurality of individual wires 32.

Core 31 is lubricated with a blend of amorphous polypropylene and conventional lubricants, synthetic lubricants and powdered solid lubricants prior to its being surrounded by thermoplastic 36 which is extruded into core 31. Thereafter plurality of outer strands 34 are wound about core 32 in the conventional manner. The strands 34 also having been lubricated with a blend of amorphous polypropylene and conventional lubricants, synthetic lubricants and powdered solid lubricants.

What is claimed is:

1. A wire rope comprising a core and a plurality of outer strands surrounding said core strand, a lubricant blend permeating the core strand and the outer strands and a thermoplastic encapsulating the core strand and the outer strands, wherein said lubricant blend comprises amorphous polypropylene and a lubricant capable of bonding to the thermoplastic.

2. The wire rope of claim 1, wherein the thermoplastic extends radially outwardly to the outer periphery of the outer strands.

3. The wire rope of claim 1, wherein the thermoplastic extends radially outwardly beyond the outer periphery of the outer strands.

4. The wire rope of claim 1, wherein said lubricant comprise petrolatum and asphaltic based lubricants.

5. The wire rope of claim 1, wherein said lubricant includes molybdenum disulphide powder.

6. The wire rope of claim 1 wherein the thermoplastic combines with said lubricant blend.

7. A wire rope comprising a core and strands surrounding the core strand, a lubricant coating the core strand encapsulating the core strand, wherein said lubricant comprises a blend of amorphous polypropylene and a lubricant capable of bonding to the thermoplastic.

8. The wire rope of claim 7 wherein said lubricant includes petrolatum and asphaltic based lubricants.

9. The wire rope of claim 7 wherein said lubricant includes molybdenum disulphide powder.

10. The method of manufacturing a wire rope including the steps of winding individual wires to form a core and several outer strands, coating the core strand and the outer strands with a lubricant comprising a blend of amorphous polypropylene and a lubricant, wiping the excess of said lubricant blend from the outer surfaces of said core and the outer strands, winding said core and said outer strands to form a wire rope, and injecting a thermoplastic into said wire rope, said lubricant bonding to said thermoplastic.

11. The method of claim 10 wherein said thermoplastic is extruded under pressure during the formation of the wire rope.

12. The method of claim 10 wherein said thermoplastic encapsulates the core strand and the outer strands.

13. The wire rope of claim 1 wherein said lubricant is selected from the group of conventional lubricants, synthetic lubricants and powdered solid lubricants.

* * * * *